US005240420A

United States Patent [19]

Roberts

[11] Patent Number: 5,240,420

[45] Date of Patent: Aug. 31, 1993

[54] SELF-ALIGNING HIGH-DENSITY PRINTED CIRCUIT CONNECTOR

[75] Inventor: Joseph A. Roberts, Grafton, N.H.

[73] Assignee: Research Organization For Circuit Knowledge, Grafton, N.H.

[21] Appl. No.: 861,119

[22] Filed: Mar. 31, 1992

[51] Int. Cl.[5] ..... H01B 9/09

[52] U.S. Cl. ..... 439/62; 439/67; 439/77; 439/493

[58] Field of Search ..... 439/59, 62, 69, 77, 439/260, 492, 493, 495, 499, 629, 630, 632-634, 636

[56] References Cited

U.S. PATENT DOCUMENTS

| | | | |
|---|---|---|---|
| 3,941,448 | 3/1976 | Evans | 439/493 |
| 4,172,626 | 10/1979 | Olsson . | |
| 4,225,205 | 9/1980 | Sinclair et al. . | |
| 4,227,767 | 10/1980 | Mouissie | 439/493 |
| 4,509,098 | 4/1985 | DasGupta et al. . | |
| 4,509,099 | 4/1985 | Takamatsu et al. . | |
| 4,531,793 | 7/1985 | Hochgesang . | |
| 4,581,495 | 4/1986 | Geri et al. . | |
| 4,583,800 | 4/1986 | Roberts et al. . | |
| 4,587,596 | 5/1986 | Bunnell . | |
| 4,597,617 | 7/1986 | Enochs . | |
| 4,602,317 | 7/1986 | Rovnyak et al. . | |
| 4,621,305 | 11/1986 | Daum . | |
| 4,740,867 | 4/1988 | Roberts et al. . | |
| 4,969,824 | 11/1990 | Casciotti | 439/67 |
| 5,080,595 | 1/1992 | Mouissie | 439/67 |

OTHER PUBLICATIONS

Rice et al., Circuit Board Assembly, IBM Tech. Disc. Bull., vol. 4, #9, Feb. 1962, p. 7.

IBM Corp., Cable Connector, IBM Tech. Disc. Bull., vol. 28, #11, Apr. 1986, pp. 4989 & 4990.

*Primary Examiner*—Paula A. Bradley

*Attorney, Agent, or Firm*—Davis, Bujold & Streck

[57] ABSTRACT

A connector for electrically conductive connection to electrically conductive contact pads of a circuit comprising a rigid housing; a flexible circuit housed, at least in part, in said housing and having an end portion carrying a row of conductive circuit areas on one face thereof corresponding to said row of pads; a spring structure having a resilient arched feature and being held captive by the housing while being permitted a limited desired float, the flexible circuit being captively located relative to the housing so that the areas are resiliently urged by the arched feature into electrically conductive contact with the pads when the connector is attached at a desired location to the circuit. The flexible circuit being releasable constrained in alignment with the spring structure by alignment elements of the spring structure, the alignment elements engaging a cooperating feature of the circuit to register the areas with the pads, when the connector is attached at a desired location to the circuit, with sufficient accuracy to ensure that only the desired conductive contact between the areas and the pads is achieved.

18 Claims, 6 Drawing Sheets

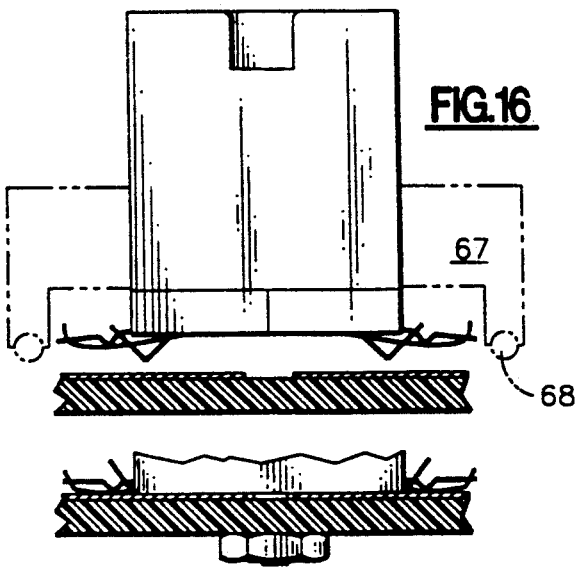
FIG.16
FIG.17
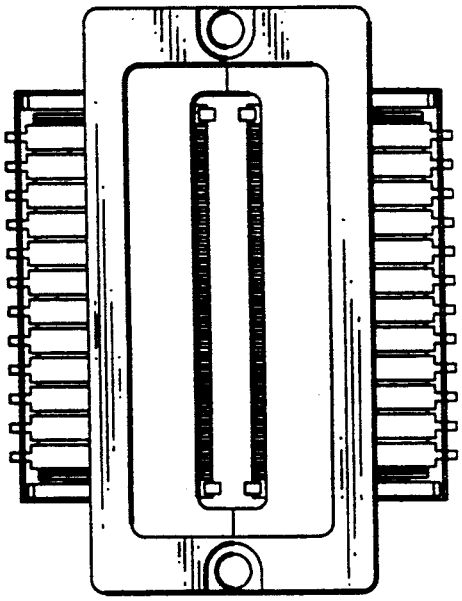
FIG.19
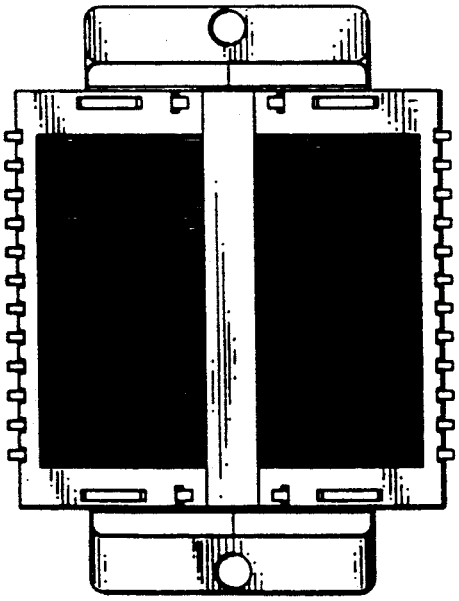
FIG.20
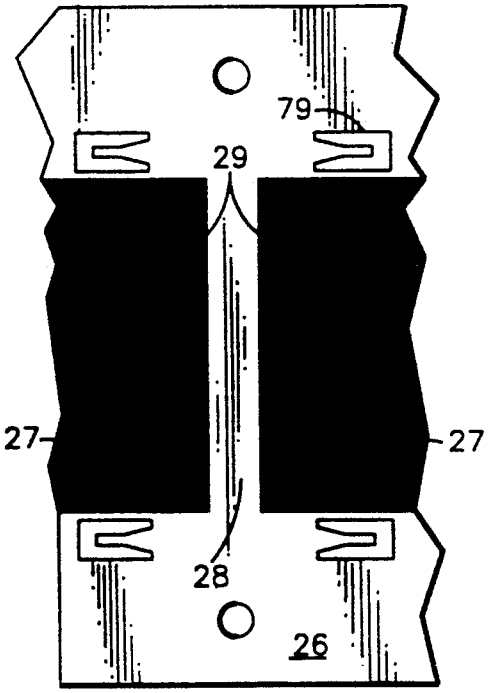
FIG.21

SELF-ALIGNING HIGH-DENSITY PRINTED CIRCUIT CONNECTOR

This invention relates to a self-aligning high-density printed circuit connector system. It relates more particularly, though not exclusively, to connectors for releasably connecting contacts of a flexible or rigid circuit to conductive pads on a printed circuit board and to the interconnection of conductive pads on two such boards.

BACKGROUND OF THE INVENTION

In electrical systems, flexible printed circuits are employed as electrical jumpers or cables for interconnecting rows of terminal pins or pads of printed circuit boards. A connector, mounted to one or both ends of the jumper, is formed with a set of electrical receptacles or sockets which are designed to receive the terminal posts or contact the pads on the printed circuit board.

In today's world wide electronics market, manufacturers are placing emphasis on increasing their product's reliably and reducing assembly costs to remain competitive. A primary focus of each manufacturer is to reduce the cost and increase the circuit density associated with interconnecting the sub-assemblies and components found within its products. Another emerging focus in today's electronics market is to pack more electronic functions into smaller packages. This means higher density modules, each requiring multiple interconnections to other modules.

Connector manufacturers have not kept pace with today's market needs. Simply stated, conventional connector technology cannot accommodate todays high-density requirements. This is because existing connectors consist of individual stamped contacts assembled into a molded plastic housing. The physical size required to manufacture an acceptable spring contact eliminates this technology in high-density circuits. For the last 25 years electronic systems have been designed around conventional connector technology. Connector manufacturers have effectively lead this market, and system designers gladly followed, because these connectors satisfied their needs. This cannot continue as three significant events are combining to change the role of connectors forever. They are:

a) A new generation of chips that will drive PC board manufacturers to produce boards with conductors on 0.006 inch centers. These boards must be interconnected to other modules or to the outside world and will require a high-density connector and interconnect cable.

b) A new generation of high resolution Liquid Crystal Displays will require conductors on 0.004 inch centers. These displays must be interconnected to PC boards and/or other modules. This will require a high-density connector and interconnect cables designed to accommodate the testing of each display and simplify its termination.

c) The growing use of high-density surface mount PC boards to accommodate multiple chip arrays also require high-density connectors and custom interconnect cables for purposes of terminating.

These key events have led to development of the self-aligning high-density connector system of the present invention.

SUMMARY OF THE INVENTION

It is an object of the present invention to provide a separable connector system for reliably and releasably connecting the conductive circuit paths of a rigid or flexible circuit to very closely packed (high density) conductive pads of a PC board in a way that does not require solder, crimping or welding operations in order to interconnect the two circuits.

A further object of the invention is to provide a connector system for connecting a rigid or flexible circuit to high density terminal pads of a printed circuit board which is self-aligning to ensure reliable desired connection.

A further object is to provide such a connector system which can be formed as an inexpensive structure.

A further object is to provide a connector system which is relatively easy and inexpensive to make in quantity.

A further object of the invention is to provide such a connector system which can be mounted to the end of a rigid or flexible circuit without requiring any tool and which can be readily connected to and aligned with contact pads on the face of a printed circuit board.

One form of the present invention is designed to interconnect two printed circuit (PC) boards and can accommodate up to 160 connectors per inch (80 connectors on each side of the PC board), i.e. four times the density of existing single row connector technology. Applications with greater densities are expected to be accommodated by the present invention.

Still another objective of this invention is to provide a positive indication that the spring has been fully compressed indicating that the connector is properly attached. This is particularly important to accommodate blind insertion of PC boards in the field.

According to the invention there is provided a connector for electrically conductive connection to electrically conductive contact pads of a circuit comprising a rigid housing; a flexible circuit housed, at least in part, in said housing and defining a row of conductive contact areas on one face thereof corresponding to said row of pads; spring means captively supported in said housing, said spring means having a resilient arched feature; and means for positioning the spring means and the portion of said flexible circuit within said housing so that said areas are aligned with corresponding said spring means so as to be resiliently urged by said arched feature into conductive contact with said pads when said connector is connected to said circuit at a desired location thereon.

Also according to the invention there is provided a connector for electrically conductive connection to electrically conductive contact pads of a circuit comprising a rigid housing; a flexible circuit housed, at least in part, in said housing and having an end portion defining a row of conductive contact areas on one face thereof corresponding to said row of pads; spring means held captive by said housing, said spring means having a resilient arched feature; means captively locating said spring means, while permitting a limited desired float of said spring means, in said housing; means captively locating a portion of said flexible circuit relative to said housing so that said areas are resiliently urged by said arched feature into electrically conductive contact with said pads when said connector is attached at a desired location to said circuit; and said portion of said flexible circuit being releasable constrained in alignment with said spring means by alignment means of said spring means, said alignment means engaging a cooperating feature of said circuit to register said areas with said pads, when said connector is attached at the desired location to said circuit, with sufficient accuracy to ensure that only the desired conductive contact between said areas and said pads is achieved.

Also according to the present invention said housing has an opening for locating and receiving an edge portion of said circuit carrying said contact pads in a row extending along said edge portion and desired said contact areas electrically conductively contact said pads when said edge portion is inserted in said opening; said first plurality of leaf springs are housed in said housing and said spring means includes a second plurality of parallel leaf springs which extend from said housing each corresponding to at least one contact area of said flexible circuit; said flexible circuit extends from said housing with desired said contact areas positioned to be resiliently urged by said second plurality of leaf springs into contact with a row of conductive contacts on a face of a printed circuit board, when said connector is attached to said printed circuit board at a location where said contact areas overly said conductive contacts, thereby to facilitate electrically conductive connection between corresponding conductive contacts and contact pads by way of direct connection with said circuit areas; and comprising means for attaching said housing to a said printed circuit board at such a location; wherein said portion of said flexible circuit extending from said housing is releasably constrained in alignment with said spring means by further alignment means of said spring means, said further alignment means engaging a cooperating feature of said printed circuit board to register said areas with said conductive contacts, when said connector is mounted to said printed circuit board at said location, with sufficient accuracy to ensure that only the desired conductive contact between said areas and said conductive contacts is achieved.

The self-aligning high-density connector of the present invention is designed to connect with a printed circuit board or to interconnect two printed circuit boards and encompasses new technologies. Each new technology eliminates a specific problem associated with high-density interconnections. These technical innovation include a) Dynamic Contact Spring Support structures which in preferred embodiments accommodate the specific requirements of a particular application. Their primary functions are to store and apply, on demand, the required energy necessary to achieve the desired contact pressure. The selection of spring material, thickness and width of the springs are application driven. However, the general configuration of the springs are important as they are both designed to extend through retaining holes in the flexible circuit and feature an alignment rail. In addition the springs are to be free floating (capable of moving side to side to accommodate circuit alignment) and still apply the required force necessary to terminate the flexible circuit to both a vertical and horizontal printed circuit board at the same time.

b) Spring alignment rails designed to automatically engage the PC board during the assembly operation and align the connector contacts to those of the PC board. The alignment rails are also designed to apply a minimum amount of pressure required for alignment while allowing the spring and flexible circuit to move side to side.

The alignment rails are constructed by forming two spring fingers approximately 0.025" above the surface of the spring structure. These fingers are formed in a configuration that allows them to pass through corresponding holes in the flexible circuit and latch to the top surface of the flexible circuit. This action, combined with the spring being pre-positioned in retaining holes of the flexible circuit lock the spring to the circuit. The alignment rails are designed to mate with alignment features built into the printed circuit board (i.e. etched conductors, machined notch, surface mounted lead frame, etc.).

The spring support structure has a built-in step which is designed to momentarily interrupt the springs expansion when a PC board is inserted. This step is designed to act as compression indicator and provide a positive indication, both audible and tactile feel, that the spring has been fully compressed. This will alert the installer that the connector is properly attached. This is particularly important to accommodate blind insertion of PC boards in the field.

Advantages of the present form of the invention over know prior art are:

1. Ability to terminate at least 80 separate contacts per inch.
2. Self-alignment of each contact cluster to a mating circuit pattern.
3. Interlocking alignment rails preventing circuit discontinuity under vibration.
4. Compliant contact clusters which compensate for variations in board thickness.
5. Provision of a wiping contact.
6. Provision of an optional compression seal designed to protect the contact interface.
7. Mechanical components which ensure long term reliability.
8. Stored energy contacts which offer reliable and predictable contact force.
9. The spring support structure has a built-in compression indicator that alerts the installer that the connector is properly attached.

BRIEF INTRODUCTION TO THE DRAWINGS

Embodiments of the present invention will now be described, by way of example, with reference to the accompanying drawings, in which.

Figure 7:
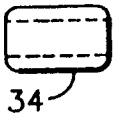
Figure 6:
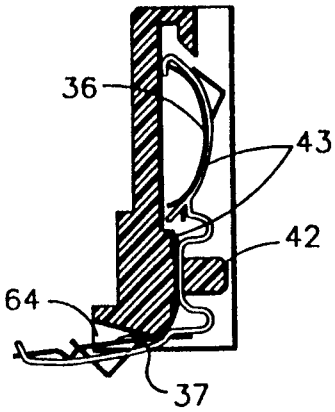
Figure 5:
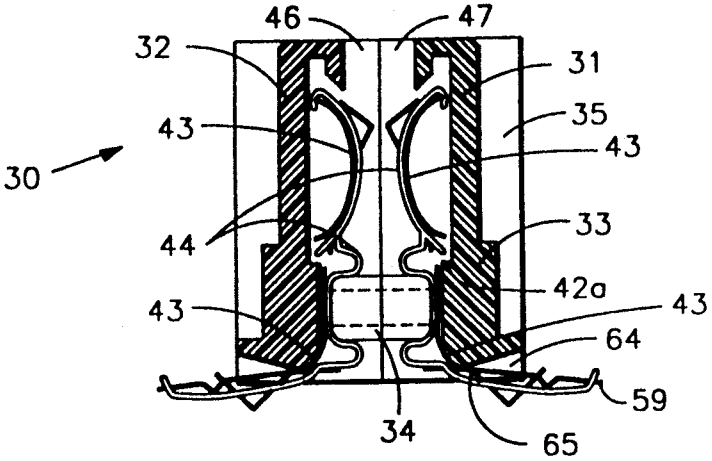
FIG. 5 is a diagrammatic cross-section view of a second embodiment of the connector according to the present invention.
Figure 15:
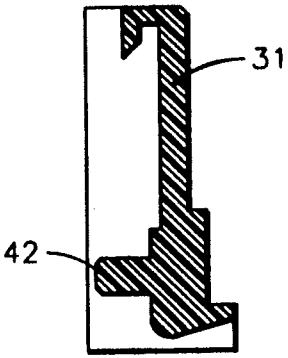
Figure 14:
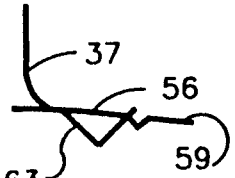
Figure 13:
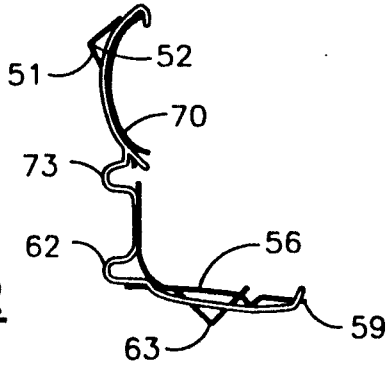
Figure 12:
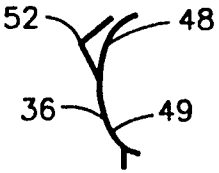
Figure 9:
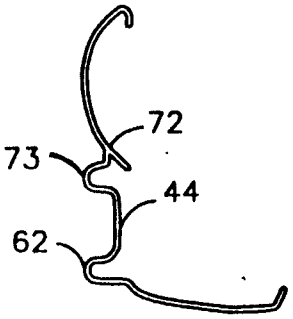
Figure 10:
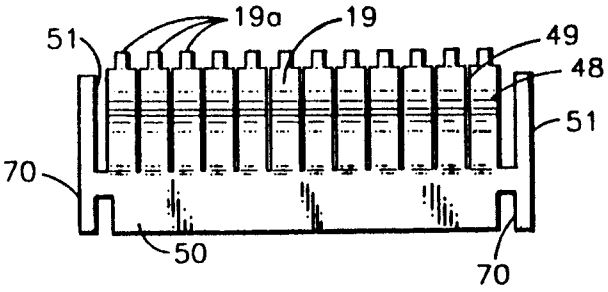
Figure 10A:
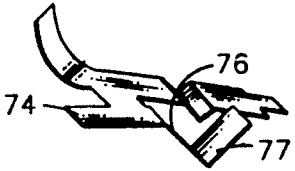
Figure 11:
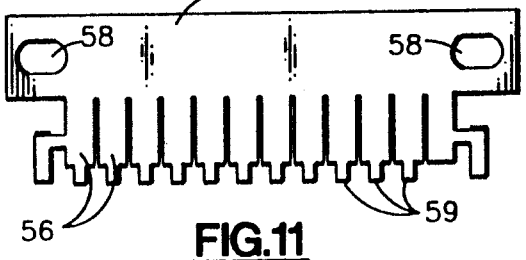
Figure 8:
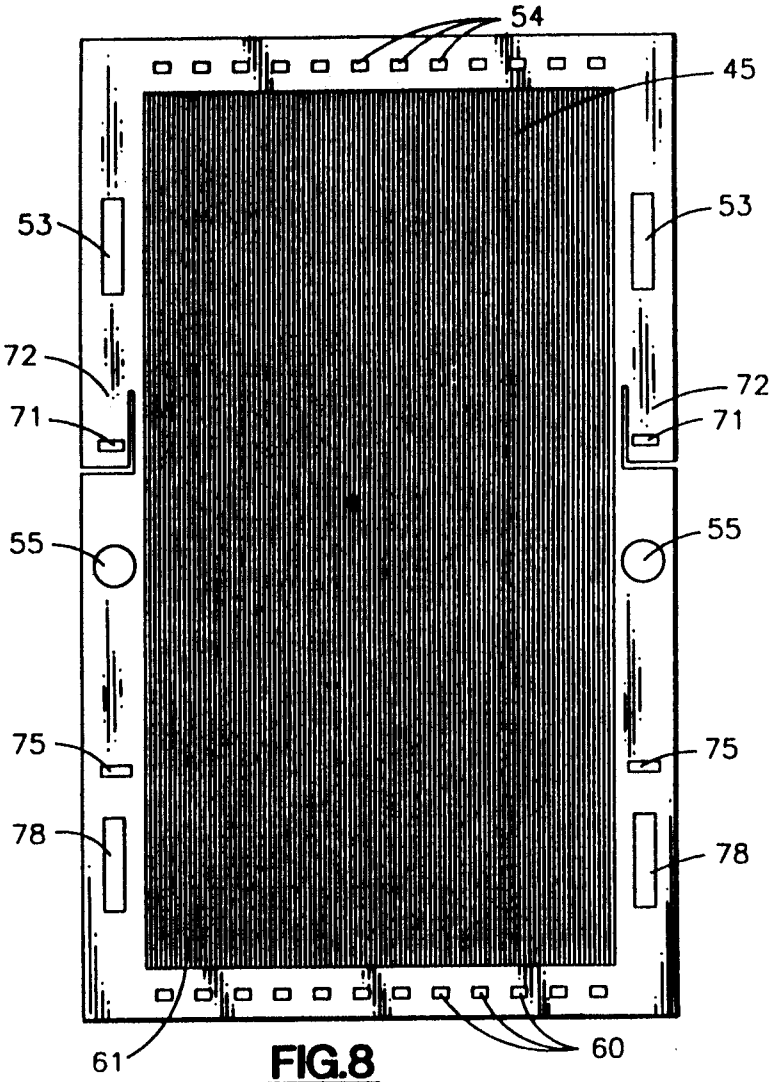
Figure 18:
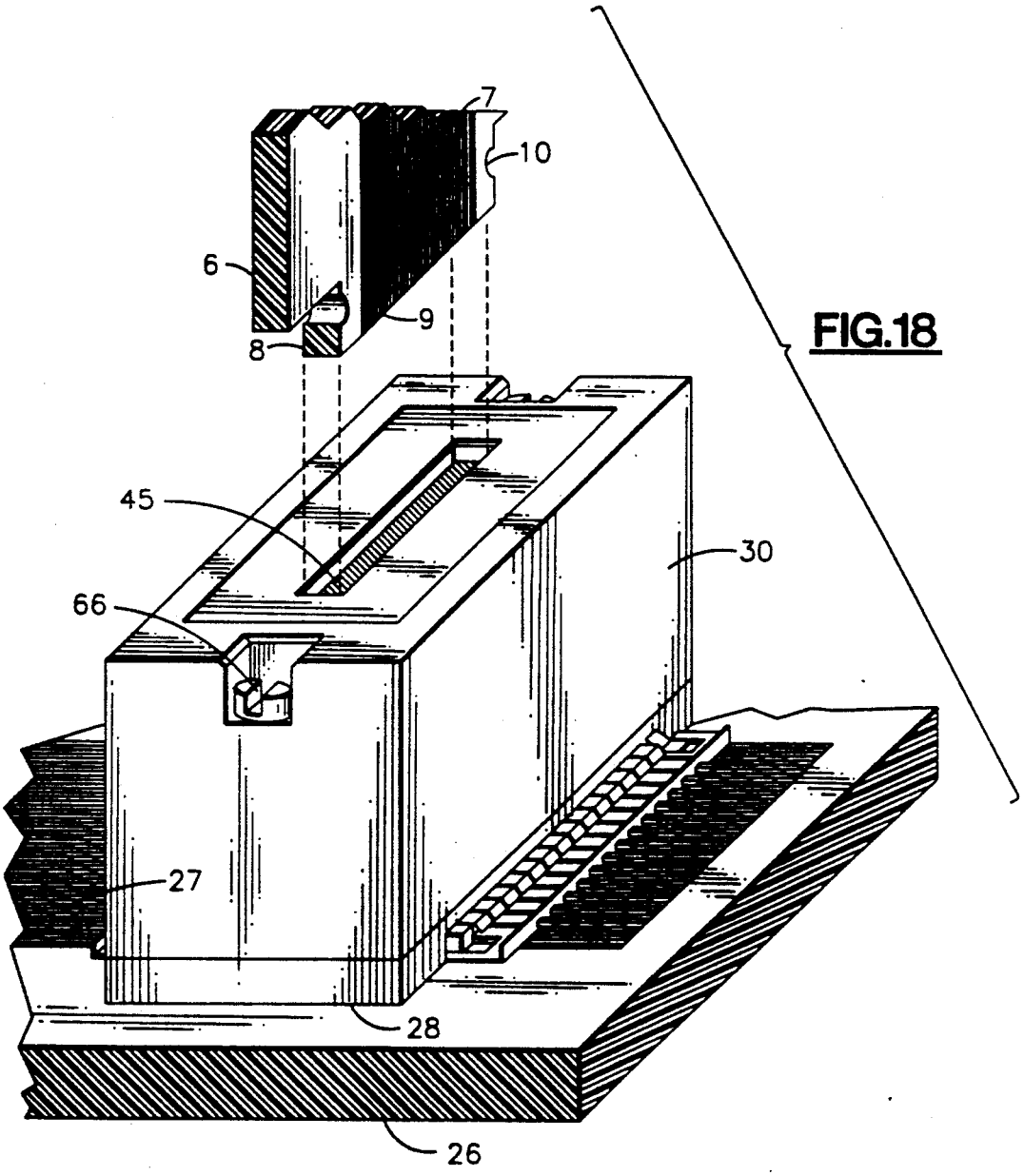

FIGS. 6–15 are diagrammatic illustrations of the various components and one sub-assembly of the connector illustrated in FIG. 5 with FIG. 6 being a sub-assembly of a housing, spring means and flexible circuit of a substantial portion of one half of the connector illustrated in FIG. 5, FIG. 7 being a cross-section of a spacer, FIG. 8 being a front elevation of a flexible circuit, FIG. 9 being a side elevation of the flexible circuit illustrated in FIG. 8 showing the shape of that circuit when it is utilized in the connector, FIG. 10 being a front elevation of a first part of a spring means, FIG. 10A being an enlarged perspective view of a portion of a second part of a spring means, FIG. 11 being a front elevation of the second part of the spring means, FIG. 12 being a side-elevation of the first part of the spring means as illustrated in FIG. 10, FIG. 13 being a side elevation of the spring means when assembled to the flexible circuit, FIG. 14 being a side-elevation of the second part of the spring means as illustrated in FIG. 11 and FIG. 15 being a diagrammatic cross-section of another half of a housing structure;

FIG. 16 is a diagrammatic end elevation of a connector of the second embodiment;

FIG. 17 is a diagrammatic end elevation of a connector of the second embodiment shown attached to the face of a printed circuit board;

FIG. 18 is a diagrammatic perspective view of the second embodiment of the connector according to the present invention shown mounted on a printed circuit board together with a second printed circuit board having an edge connector portion carrying electrically conductive contact pads for interconnection with the first mentioned circuit board by way of the connector;

FIG. 19 is a plan view of a connector of the second embodiment;

FIG. 20 is an underview of a connector of the second embodiment; and

FIG. 21 is a view of the face of a printed circuit board to which a connector of the second embodiment may be mounted.

DESCRIPTION OF PREFERRED EMBODIMENTS

The following description of the preferred embodiments is exemplary only and it will be appreciated that specific limitations as to materials, dimensions, numbers, etc., are not intended to restrict the scope of the present invention as defined in the claims hereinafter set forth.

The first embodiment of connector according to the present invention will now be described with reference to FIGS. 1–4.

A molded plastic connector housing 1 consists of first and second housing halves 2 and 3 spaced apart by a spacer 4 of an electrically insulating material. The housing halves 2 and 3 are joined together, to form the housing 1, by a support ring 5 which in the assembled connector encompasses the housing halves. The support ring may be molded of plastic and may join the housing halves 2 and 3 together in a substantially permanent manner by the use of ultrasonics, adhesives or other means well known to those skilled in the art.

PC board 6 carries an array of circuit paths 7 terminating at an edge connector portion 8 in a row of electrically conductive contact pads 9. A similar row of pads (not shown) is located on the underside of the PC board 6 with the two rows of pads being superimposed as a mirror image of one another. The edge connector portion 8 includes recesses 10 which may be used to captively locate the PC board relative to the connector housing 1 by means of pins 11 passing through openings in the housing 1. Although these pins 11 are shown installed in the housing 1, it will be appreciated that in actual use they will be installed only after the edge connector portion 8 is inserted into the housing.

The first and second housing halves 2 and 3 each include a pair of spaced apart mounting pins 12 (one only being shown for each housing half) by means of which the internal components of the connector, including the spacer 4, are captively held and located within the housing 1. The internal components consist of a pair of spring means 13 and a pair of flexible circuits 14 each circuit comprising a flexible substrate carrying a plurality of electrical conductors terminating, at an end of the flexible circuit within the connector, in electrically conductive circuit areas 15 positioned to connect with the pads of the PC board when the connector is attached the edge connector portion of the PC board.

Figure 3B:
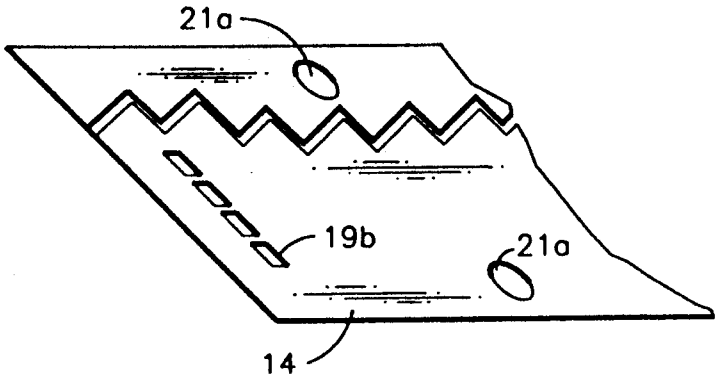
Figure 3A:
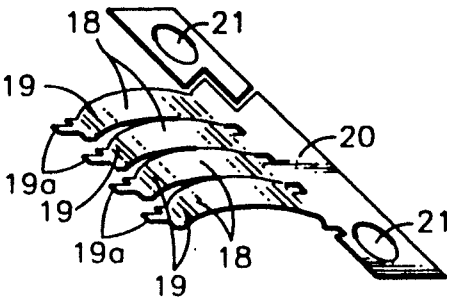

The flexible circuits 14 extend into a cavity 16 of the housing 1 and are located by the pins 12 which engage openings 21A in the flexible circuits 14 so that the areas 15 of the flexible circuits 14 align with the pads of the PC boards 6 when the edge connector portion 8 thereof is inserted into the connector through an edge connector portion receiving aperture 17 of the housing. The flexible circuits 14 are spaced apart by the spacer 4, with their contact areas facing one another, and are biased toward one another by arched portions 18 of the spring means 13 which are located in the housing by engagement of openings in the spring means with the pins 12 between the flexible circuits 14 and the respective housing halves 2 and 3. The arched portions 18 of the spring means 13 overlap the aperture 17 to resiliently bias the contact areas 15 of the flexible circuit into engagement with pads of a PC board to which the connector is attached. Each spring means 13 (FIG. 3*a*) is a comb-like metal structure in which the arched portions 18 are formed in parallel leaf spring portions 19 interconnected at one end thereof by a cross-member 20. The cross-member serves to maintain the leaf spring portions 19 in parallel alignment with one another and to located the spring means relative to the contact areas 15 of the flexible circuit and the cavity 16 of the housing 1 by means of holes 21 positioned and sized to accommodate the pins 12.

With high-density packing of the pads 9, the holes 21 may be sized, together with the corresponding openings of the flexible circuits, to allow a desired amount of float of the spring means 13 and the flexible circuits 14 to ensure proper alignment of the contact areas 15 and the pads for the desired electrical connection of the pads directly with the contact areas 15 under the influence of the resilient arched portions of the spring means 13. With the allowed float and use in high density packing of the pads, alignment means ensuring registration of contact areas and pads is provided as described hereinafter.

In the illustrated embodiment, each leaf spring 19 is common to four contact areas. It will be appreciated by those skilled in the art that each particular application will determine the number of contact areas common to each leaf spring and that a single leaf spring construction common to all contact areas of each flexible circuit may find application where the resilient compressibility of the substrate of the flexible circuit and/or an intermediate element is provided to ensure the application of a sufficiently even electrical contact producing pressure between the contact areas 15 and the pads throughout the length of the rows of pads. The spring means 13 are each captively retained by the pins 12 of the associated housing halves 2 or 3 with the free ends of the leaf springs 19 engaging a housing recess 22 adjacent the aperture 17. The ends of each of the leaf springs 19 are shaped to define tabs 19*a* which engage corresponding openings 19*b* in the end portion of the associated flexible circuit 14 to locate the flexible circuit relative to the leaf spring. With high-density packing of the pads 9, the contact of the leaf springs and the flexible circuits with the recesses 22 is sufficiently free to allow sufficient floating movement of the spring means 13 with its associated flexible circuit 14 to allow the desired alignment between the contact areas 15 and the pads of the PC boards 6. To this end the spacer 4 has recessed areas 23 which prevent the leaf springs 13 and the flexible circuits 14 from being tightly clamped against the first and second housing halves 2 and 3. In the embodiment shown the holes 21 are oval in order to facilitate the desired floating movement.

Figure 1:
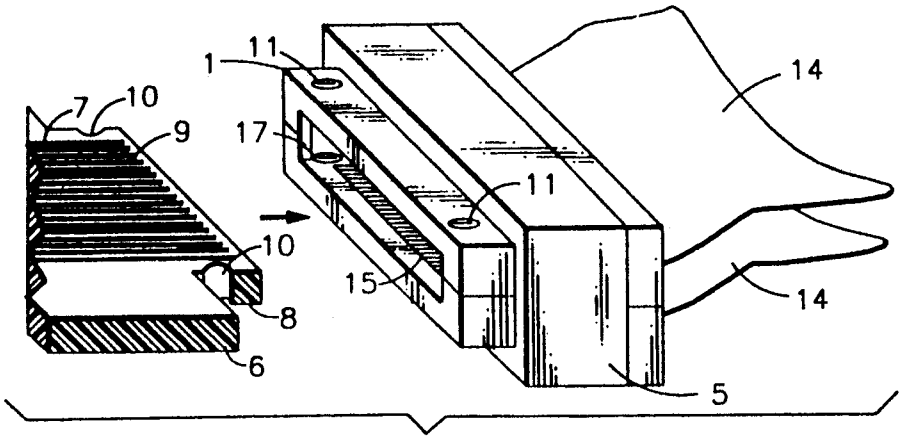
FIG. 1 is a diagrammatic perspective view of a first embodiment of a connector according to the present invention shown with a portion of a printed circuit having an edge connector portion carrying a plurality of electrically conductive contact pads.
Figure 3:
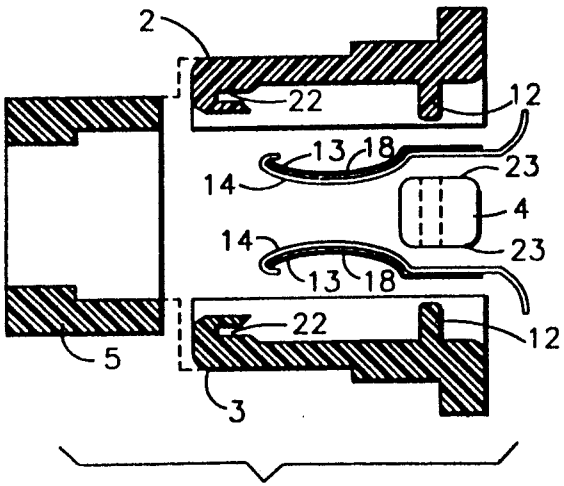
FIG. 3 is an exploded view similar to the cross-section of FIG. 2 illustrating the various components of the connector of the first embodiment with FIGS. 3A and 3B being diagrammatic fragmentary illustrations of two of these components.
Figure 2:
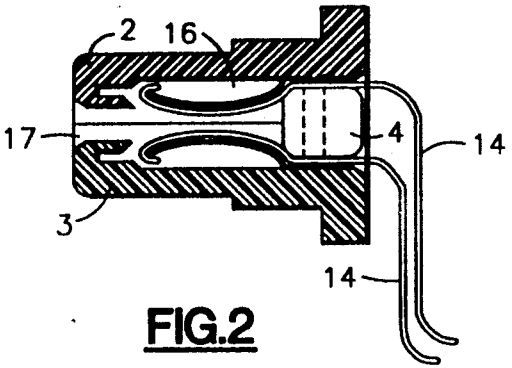
FIG. 2 is a diagrammatic cross-section of the connector illustrated in FIG. 1.
Figure 4:
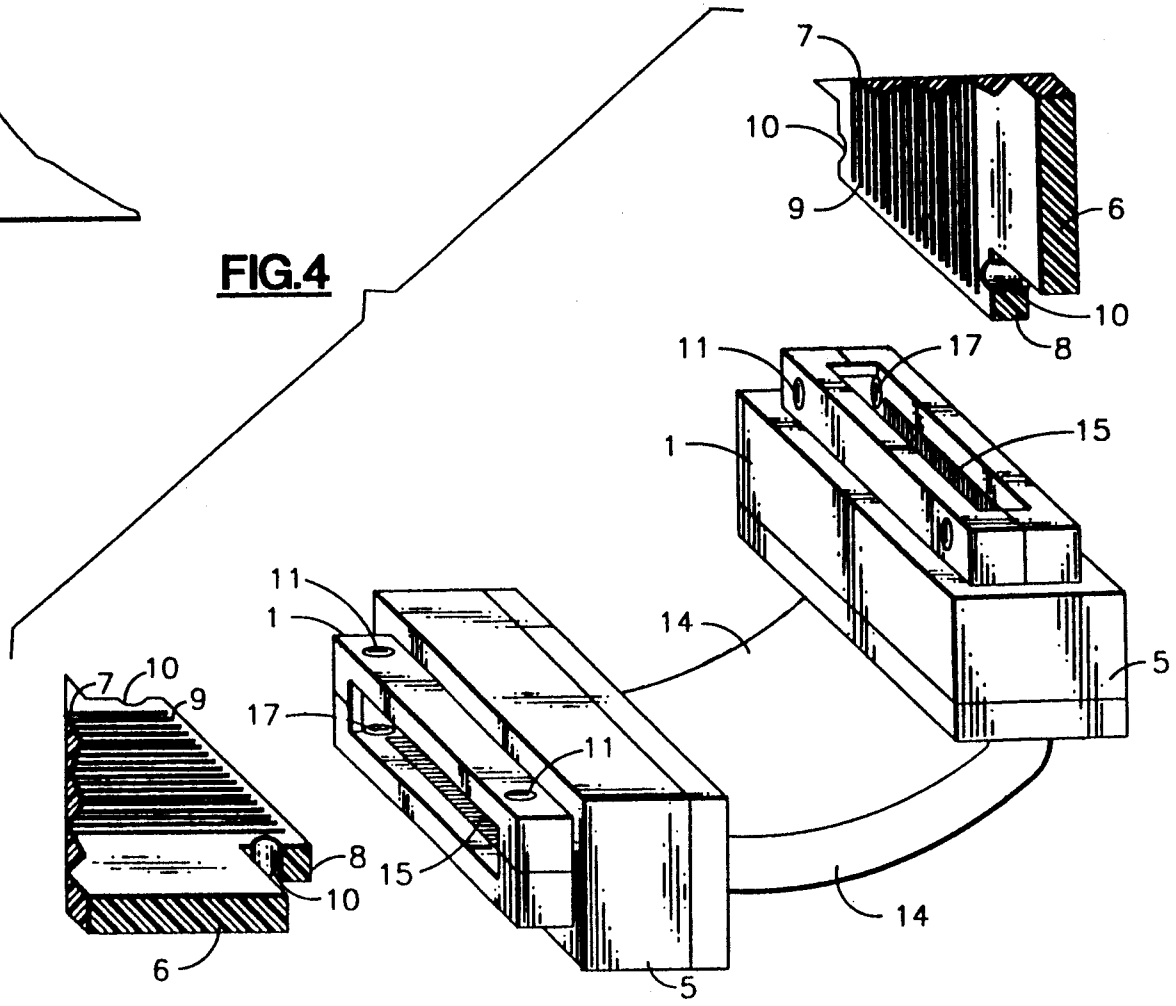
FIG. 4 is a diagrammatic perspective view of two connectors of the first embodiment interconnected by flexible circuits shown together with two printed circuit boards, each having edge connector portions carrying electrically conductive contact pads, interconnected by the flexible circuits.

The ends of the flexible circuits 14 which are remote from the connector described may be terminated in any conventional manner or may be terminated in a similar connector to that described (FIG. 4).

It will be appreciated that the engagement of the leaf springs 19 with their attached flexible circuits to the recesses 22 is to ensure that the free ends of the leaf springs 19 and the associated end portions of the flexible circuits 14 do not interfere with the insertion of an edge connector portion of a PC board to the connector. The free end portions of the leaf springs 19 and the cross-member 20 serve to provide the contact with the first and second housing halves 2 and 3 required for the application of the necessary spring force by the arched portion of the leaf spring to achieve the desired electrical contact between the contact areas and the pads.

The spring means 13 may be constructed of a material or coated with a suitable material to provide, with the substrate of the flexible circuits, an impedance desired where the flexible circuit communicates direct with a PC board.

FIG. 4 illustrates the use of a connector according to the first embodiment together with a second similar connector to interconnect two printed circuit boards each having edge connector portions carrying rows of electrically conductive contact pads on both faces of each edge portion with the interconnection being by direct communication with contact areas at the ends of the flexible circuits which are common to the connectors. Each connector is substantially of the form described and illustrated with reference to FIGS. 1, 2 and 3.

The second embodiment of the invention will now be described with reference to FIGS. 5–21. The connector of the second embodiment includes construction features which function substantially in the same way as the features of the first embodiment of the connectors described with reference to FIGS. 1–4 for connection to an edge connector portion of a printed circuit board 6 carrying rows of pads as described with reference to the first embodiment. However, the connector of the second embodiment is designed as a self-aligning high-density connector for mounting directly to one face of a further printed circuit board 26 having conductive paths 27 terminating at a connector location 28 in contact pads 29 disposed in parallel rows of pads having a high density center to center spacing of, for example, 12 mils.

In the second embodiment connector 30 has a molded plastic connector housing 31 consisting of first and second housing halves 32 and 33 spaced apart by a spacer 34 of an electrically insulated material, the housing halves 32 and 33 being joined together to form the housing 31 by a support ring 35 which in the assembled connector encompasses the housing halves. The support ring may be molded of plastic and may join the housing halves 32 and 33 together in a substantially permanent manner by the use of adhesives or other means well known to those skilled in the art.

The first and second housing halves 32 and 33 each include a pair of spaced apart mounting pins 42 (one only being shown for each housing half) by means of which certain internal components of the connector including the spacer 34 are captively held within the housing 31. The internal components consists of a pair of spring means 43 each consisting of first and second spring structures 36 and 37 and a pair of flexible circuits 44 each comprising a flexible substrate carrying a plurality of electrical conductors terminating, at one end of the flexible circuit within the connector, in electrically conductive contact areas 45 positioned to connect with the pads 9 of the PC board when the connector is mounted on the edge connector portion 8 of the PC board 6.

The flexible circuits 44 extend into a cavity 46 of the housing 31 and are located by the pins 42 which engage openings in the flexible circuits 44 to retain them within the housing 31. The flexible circuits 44 are spaced apart by the spacer 34 with their contact areas facing one another and are biased toward one another by arched portions 48 of the first spring structures 36 of the spring means 43 which are located in the housing by engagement with abutment 42*a* between the flexible circuits 44 and the respective housing halves 32 and 33. The arched portions 48 of the spring means 43 overlap the aperture 47 to resiliently bias the contact areas 45 of the flexible circuit into engagement with pads of a printed circuit 6 on which the connector is mounted. Each first spring structure 36 (FIGS. 5, 11 and 13) is a comb-like metal structure in which the arched portions 48 are formed in parallel leaf springs 49 interconnected at one end of each leaf spring by a cross-member 50 which serves to maintain the leaf springs portions 19 in parallel alignment with one another.

At the ends of the cross-member 50 are circuit to board alignment rails 51 the free ends of which are folded to form projections 52 positioned to extend through rectangular openings 53 in the flexible circuit 44 and to engage those openings to maintain the spring means in a desired alignment with the flexible circuit. The projections 52 terminate in contact with the conductive contact area carrying face of the flexible circuits adjacent the side edges thereof. The projections 52 are designed to mate with alignment tracks (not shown) in PC boards having an edge connector portion 8 to which the connector 30 is to be connected and the rails 51 are resiliently flexible to enable the projections 52 to be urged apart as an edge connector portion of a PC is insert into the aperture 47. The projections 52 each overlap the aperture 47 by 25 mils more than the arched portions of the spring means 43 whereby the pressure otherwise applied by the arched portions is relieved somewhat until the projections 52 engage the tracks. This allows easier floating movement facilitating alignment.

The spring means 43 are accommodated in cavity 46 of the housing 31 in engagement with recesses corresponding to recesses 22 with tabs 19*a* at the ends of the leaf springs engaging corresponding rectangular openings (here 54) in one end of the flexible circuits 44 in order to retain the longitudinal alignment of the flexible circuits 44 with their associated first spring structures 36. Openings 55 locate the flexible circuits 44 in the housing by engagement with pins 42. The shape and sizing of these openings is arranged to permit sufficient float of the flexible circuits 44 together with the spring means 43 relative to the housing to ensure alignment of contact areas of the flexible circuits with contact pads of the print PC boards when the connector is connected thereto. In the preferred form the openings 55 are oval to facilitate float in a sideways direction while restricting float longitudinally of the flexible circuits. While the first spring structures 36 are captively housed in the housing 31, these spring structures are permitted a degree of float consistent with the float of the flexible circuits 44 while their alignment with those circuits is ensured by the engagement of the projections 52 with the rectangular openings 53 and tabs 19*a* with openings 54. Sufficient clearance is provided to ensure unrestricted desired deformation of the first spring structures 36 in the housing.

Tabs 70 on the first spring structures 36 aligned with the guide rails 51 are arranged to engage openings 71 in tabs 72 formed in the side edges of the flexible circuits 44 to assist in alignment, retention and positioning of the flexible circuits relative to the first spring structures 36.

The second spring structures 37, which also form part of the spring means 43, have a plurality of leaf springs interconnected at one end thereof by a cross-member 57 defining a pair of openings 58 sized and shaped to encompass the pins 42 while permitting contact aligning float of these second spring structures with the associated end of the flexible circuits 44. The end of these leaf springs also include tabs 59 arranged for cooperation with corresponding rectangular openings 60 located in the associated ends of the flexible circuits 44. Alignment of the contact areas 61 with the associated contact pads 29 of the further PC board 26 is provided by the allowed float of the second spring structure 37 and the associated ends of the flexible circuits 44 and as a result of the shape of the openings 55 and/or by the provision of a return tuck 62 in the flexible circuits 44 accommodated within the housing 31.

The second spring structures 37 also include tabs 74 (see the enlarged portion of FIG. 11) engage openings 75 in the edges of the flexible circuits to assist in alignment, retention and position thereof.

As with the first embodiment of the present invention, the spacer (here 34) includes recessed areas to facilitate the desired float of the spring means 43 and the flexible circuits 44. In both embodiments, the spring means and the flexible circuits include features ensuring their alignment. However, these components are not fixedly connected together and can move independently, within the bounds provided by the alignment arrangement, as they flex in use. In the preferred embodiment each leaf spring of each structure 36 and 37 is common to four contact areas. It will be appreciated by those skilled in the art that a particular application will determine the number of contact areas common to each leaf spring and a single leaf spring, for each structure 36 and 37, common to all contact areas of each flexible circuit end may find application where the resilient compressibility of the substrate of the flexible circuit or an intermediate element is provided to ensure the application of a sufficiently even electrical contact producing pressure between the contact areas 45 and the pads 9 and 29 throughout the length of the rows of pads.

The second spring structures 37 are formed so that the cross-member 57 mounted on the pins 42 lies not only transversely of the leaf springs 56 but also in a plane normal or substantially normal to the plane of the leaf springs 56 (FIG. 12). By virtue of this, leaf springs 56 extend through a side opening of the associated housing half 32 or 33 to enable the associated end portion of the associated flexible circuit 44 with its contact area 61 to lie on top of one face of the further PC board 26 to which the connector is to be attached. In this arrangement, the leaf springs of one of the second spring structures 37 extend oppositely to and in the same plane as the leaf springs of the other of the second spring structures 37. The leaf springs 56 include folded portions 63 adjacent their free end shaped to ensure that the leaf springs 56 resiliently urge the associated contact areas 61 into contact with the contact pads 29 when the connector is attached to the further PC board 26. The housing halves 32 and 33 include relieved areas 64 in the openings 65 through which the leaf springs 56 extend to accommodate deflection of these leaf springs in use. It will be appreciated that leaf springs are shaped in order to be resiliently deformed as the connector is attached to the further printed circuit board in order to ensure that the necessary contact of areas and pads as achieved.

Secure attachment of the connector 30 to the further printed PC board 26 may be assured by attachment screws 66 or other attachment means which will be well known to those skilled in the art. This ensures that the allowed float of the flexible circuits together with the alignment of the contact areas 61 with the pads 29, as ensured by the self-aligning provisions of the second spring structures 37 and the associated structure of the further PC board.

The second spring structures 37 include resilient guide rails 76 including folded portions 77 which pass through slots 78 in the edges of the flexible circuits to engage alignment tracks 79 formed in the further printed circuit board 26. The rails 76 extend beyond the folded portions 63 of the leaf springs 56 to relieve spring pressure during alignment and to restore that pressure once alignment is achieved.

In an alternative embodiment (not illustrated) the leaf springs 56 may be folded back upon themselves over the contact areas 61 to be encompassed with those areas 61 substantially under the sidewalls of the housing 31 whereby the housing itself essentially completely covers and protects the region in which the contact areas contact the contact pads of the further PC board 26. Alternatively, protective shrouds 67 (shown in ghost in FIG. 16) may be utilized together with an associated compression seal 68 to achieve the same end.

It will be appreciated that while the first and second embodiments of the present invention have been described utilizing a pair of flexible circuits suitable for communication with contact pads of both faces of a PC board or with two parallel rows of pads on one face of a PC board, the invention is applicable for use with a single spring means/flexible circuit arrangement for communicating with a single row of contact pads of a PC board.

It will be further appreciated that while the first and second embodiment of the present invention have described the use of a single arch spring a spring with more than one raised feature, say a tandem arch will allow the connection to more than one set of conductors. This is of particular importance, as the use of a PTH flexible circuit with say, two rows of contact backed with a tandem spring will double the density of the connector.

It will be further appreciated that while the first and second embodiment of the present invention have described the use of a single arch leaf spring designed to achieve the desires force and compliance, it should be noted that a solid may also be used. To achieve the desired compliancy we simply add a compression cushion between the circuit and the spring.

It will also be appreciated that while the spring means of the second embodiment is described and illustrated as involving first and second separate spring structures, the concepts of the present invention encompass an arrangement in which the first and second spring structures are combined into a single structure performing the functions of both the first and second spring structures described. In applications where conductors have a minimum center to center spacing of at least 25 mils the first and second spring structures may conveniently be combined into such a single spring structure.

It will also be appreciated that which the invention has been described with reference to a single row of pads on a face of a circuit, the invention is applicable to connection to more than one row of pads on the same face of the circuit. As used herein "pads" shall be construed to include exposed conductors to which electrical connection is desired.

I claim:

1. A connector for electrically conductive connection to electrically conductive contact pads of a circuit comprising a) a rigid housing;

b) a flexible circuit housed, at least in part, in said housing and having an end portion defining a row of conductive contact areas on one face thereof corresponding to said row of pads;

c) spring means held captive by said housing, said spring means having a resilient arched feature;

d) means captively locating said spring means, while permitting a limited desired float of said spring means, in said housing;

e) means captively locating a portion of said flexible circuit relative to said housing so that said areas are resiliently urged by said arched feature into electrically conductive contact with said pads when said connector is attached at a desired location to said circuit; and f) said portion of said flexible circuit being releasable constrained in alignment with said spring means by alignment means of said spring means, said alignment means engaging a cooperating feature of said circuit to register said areas with said pads, when said connector is attached at the desired location to said circuit, with sufficient accuracy to ensure that only the desired conductive contact between said areas and said pads is achieved.

2. A connector according to claim 1 wherein said alignment means comprise resilient projections of said spring means arranged to cooperate with said flexible circuit to releasable constrain said flexible circuit at least in a direction parallel to the length of said row of pads when said edge is inserted in said opening and to cooperate with an alignment feature of said circuit to ensure said registration.

3. A connector according to claim 2 wherein said resilient projections cooperate with said circuit to relieve pressure applied by said arched portion except when registration has been achieved.

4. A connector according to claim 1 wherein said spring means includes a first plurality of parallel leaf springs each having a said arched feature and each corresponding to at least one said area.

5. A connector according to claim 4 wherein said leaf springs of said second plurality of leaf springs extend from said housing in a direction generally normal to the direction of reception of said edge portion into said opening.

6. A connector according to claim 4 wherein said alignment means comprise end portions of said first plurality of leaf springs arranged to engage openings in said flexible circuit to releasable constrain said flexible circuit longitudinally of the leaf springs.

7. A connector according to claim 4 wherein a) said connector is for connection to an edge portion, of said circuit, having opposed faces each carrying a row of said contact pads;

b) said housing houses a separate spring means associated with each said row of pads;

c) each said spring means includes a said first plurality of parallel leaf springs each having an arched portion and each corresponding to at least one said contact area; and d) a separate said flexible circuit is provided for each said row of pads, each located, releasably constrained and resiliently urged in the same said manner.

8. A connector according to claim 7 wherein said arched portions of said first plurality of leaf springs of said separate spring means are arched toward one another and said contact areas of the separate flexible circuits face one another within said housing.

9. A connector according to claim 4 wherein said alignment means comprises openings in said flexible circuit to encompass pins in said housing with sufficient clearance to allow the desired float.

10. A connector according to claim 9 wherein said alignment means comprises openings in said spring means to encompass said pins with sufficient clearance to allow the desired float.

11. A connector according to claim 4 wherein a) said housing has an opening for locating and receiving an edge portion of said circuit carrying said contact pads in a row extending along said edge portion and desired said contact areas electrically conductively contact said pads when said edge portion is inserted in said opening;

b) said first plurality of leaf springs are housed in said housing and said spring means includes a second plurality of parallel leaf springs which extend from said housing each corresponding to at least one contact area of said flexible circuit;

c) said flexible circuit extends from said housing with desired said contact areas positioned to be resiliently urged by said second plurality of leaf springs into contact with a row of conductive contacts on a face of a printed circuit board, when said connector is attached to said printed circuit board at a location where said contact areas overly said conductive contacts, thereby to facilitate electrically conductive connection between corresponding conductive contacts and contact pads by way of direct connection with said circuit areas; and comprising d) means for attaching said housing to a said printed circuit board at such a location; wherein e) said portion of said flexible circuit extending from said housing is releasably constrained in alignment with said spring means by further alignment means of said spring means, said further alignment means engaging a cooperating feature of said printed circuit board to register said areas with said conductive contacts, when said connector is mounted to said printed circuit board at said location, with sufficient accuracy to ensure that only the desired conductive contact between said areas and said conductive contacts is achieved.

12. A connector according to claim 11 wherein said leaf springs of said first and second pluralities of leaf springs are aligned and joined to by and extend in opposite directions from a transverse cross-member.

13. A connector according to claim 11 wherein said first and second pluralities of leaf springs are separate and said leaf springs of said second plurality of leaf springs each include an arched portion positioned to provide said resilient urging of said areas into conductive contact with said conductive contacts.

14. A connector according to claim 11 wherein said alignment means comprise end portions of said second plurality of leaf springs arranged to engage openings in said flexible circuit to releasable constrain said flexible circuit longitudinally of the leaf springs.

15. A connector according to claim 11 wherein a) said printed circuit board includes two rows of said conductive contacts and a separate spring means is associated with each said row of conductive contacts;

b) each said spring means includes a second plurality of parallel leaf springs each having an arched portion and each corresponding to at least one said contact area;

c) a separate said flexible circuit is provided for each said row of conductive contacts, each flexible circuit being located, releasably constrained and resiliently urged in the same said manner d) the leaf springs of the second pluralities of parallel springs extending in opposite directions from said housing generally normal to the direction of reception of said edge portion into said opening and each second plurality of parallel springs being positioned to urge desired contact areas into contact with associated said conductive contacts when said connector is attached to said printed contact board with said contact areas overlying said conductive contacts.

16. A connector according to claim 15 wherein said arched portions of the said leaf springs of said first pluralities of leaf springs are arched toward one another and desired said circuit areas face one another within said housing.

17. A connector according to claim 11 wherein said further alignment means comprise resilient projections of said spring means arranged to cooperate with said flexible circuit to releasable constrain said flexible circuit at least in a direction parallel to the length of said row of conductive contacts when said connector is attached to said printed circuit board and to cooperate with an alignment feature of said circuit board to ensure said registration.

18. A connector according to claim 12 wherein said resilient projections of said further alignment means cooperate with said circuit board to relieve pressure applied by said arched portions except when registration has been achieved.

* * * * *